United States Patent [19]

Mano et al.

[11] Patent Number: 4,985,698

[45] Date of Patent: Jan. 15, 1991

[54] DISPLAY PANEL DRIVING APPARATUS

[75] Inventors: Hiroyuki Mano; Terumi Takashi, both of Yokohama; Kazuhiro Fujisawa, Fujisawa; Kaoru Hasegawa, Chiba; Shinzo Matsumoto, Mobara; Mitsuhisa Fujita, Chiba, all of Japan

[73] Assignee: Hitachi, Ltd., Tokyo, Japan

[21] Appl. No.: 261,994

[22] Filed: Oct. 25, 1988

[30] Foreign Application Priority Data

Oct. 28, 1987 [JP] Japan ..... 62-270126

[51] Int. Cl.[5] ..... G09G 3/36

[52] U.S. Cl. ..... 340/784; 340/805

[58] Field of Search ..... 340/784, 805, 719, 765; 350/333, 334

[56] References Cited

U.S. PATENT DOCUMENTS

| | | | |
|---|---|---|---|
| 4,317,115 | 2/1982 | Kawakami et al. | 340/784 |
| 4,630,122 | 12/1986 | Morokawa | 340/784 |
| 4,679,043 | 7/1987 | Morokawa | 340/784 |
| 4,745,485 | 5/1988 | Iwasaki | 340/784 |
| 4,816,816 | 3/1989 | Usui | 340/784 |

FOREIGN PATENT DOCUMENTS 59-211021 11/1984 Japan .

61-52631 3/1986 Japan .

*Primary Examiner*—Alvin E. Oberley
*Assistant Examiner*—M. Fatahiyar
*Attorney, Agent, or Firm*—Antonelli, Terry, Stout & Kraus

[57] ABSTRACT

An apparatus for driving a color display panel operating at a high frame frequency. The color display panel driving apparatus includes a line memory for storing data of ½ of a line at its odd-numbered addresses and then storing data of the remaining ½ of the line at its even-numbered addresses, a first column drive circuit including a shift register to which the data stored at the odd-numbered addresses of the line memory are supplied and which is connected at its bit outputs to column-direction signal wires associated with a left-hand half display area of the display panel, and a second column drive circuit including a shift register to which the data stored at the even-numbered addresses of the line memory are supplied and which is connected at its bit outputs to column-direction signal wires associated with a right-hand half display area of the display panel. After picture data of one line are completely stored in the line memory, the picture data are substantially simultaneously supplied from the odd-numbered and even-numbered addresses of the line memory to the first and second column drive circuits respectively.

9 Claims, 6 Drawing Sheets

| ADDRESS | 0 | 1 | 2 | 3 | 156 | 157 | 158 | 159 |
|---|---|---|---|---|---|---|---|---|
| | R0 | R80 | R1 | R81 | R78 | R158 | R79 | R159 |
| | G0 | G80 | G1 | G81 | G78 | G158 | G79 | G159 |
| | B0 | B80 | B1 | B81 | B78 | B158 | B79 | B159 |

DISPLAY PANEL DRIVING APPARATUS

BACKGROUND OF THE INVENTION

This invention relates to a color display, and more particularly to an apparatus for driving a color liquid crystal display panel which has a relatively large display area, which can display a reproduced picture with a high resolution and which is suitable for use as a display incorporated in, for example, computer systems and various kinds of control apparatus.

An apparatus for driving a color liquid crystal display panel is disclosed in, for example, JP-A-59-211021. The disclosed display panel driving apparatus includes a frame memory for storing color display data temporarily. The color data of red, green and blue corresponding to individual lines of the color liquid crystal display panel respectively are then repeatedly read out from the frame memory to be supplied to the color liquid crystal display panel.

The color liquid crystal display panel used in the prior art display panel driving apparatus has a relatively large display area of, for example, 640 dots × 200 dots. Thus, when the color liquid crystal display panel having such a relatively large display area is to be driven for displaying a picture, the amount of display data required to display the picture increases correspondingly, and this leads to the problem that the frame memory must have an increased memory capacity.

Further, in the prior art color liquid crystal display panel driving apparatus described above, color data of red (R), green (G) and blue (B), each for displaying 640 dots, are to be supplied to the color liquid crystal display panel in one horizontal period. These display data are serially supplied as an input to a column-direction (X) signal-wire drive circuit which is connected to the color liquid crystal display panel and includes a shift register. The supplied display data are serial/parallel converted by the shift register, and the parallel display data are supplied to the column-direction signal wires from the respective bit outputs of the shift register.

The frame frequency required for the color display by the color liquid crystal display panel is dependent upon the data transfer rate of the X (signal-wire) drive circuit carrying out the serial/parallel conversion of the color data. When, for example, an X drive circuit of the type "HD66106" sold by Hitachi, Ltd. and having a maximum data transfer rate of 6 MHz is used for the serial/parallel conversion, the frame frequency f is given by the following equation (1):

$$f = 1/(1/6\ \text{MHz}) \times (640/4) \times (200 \times 3) = 62.5\ \text{Hz} \quad (1)$$

In the above equation (1), the second member, (640/4), of the denominator means that the unit of color data serially transferred is 4 bits, and the third member, (200×3), of the denominator means that three primary color lines of R, G and B constitute one color dot (line).

When the frame frequency f is only of the order of 62.5 Hz as described above, the color liquid crystal display panel encounters such problems as flickering display of a picture and degradation of the picture quality at high temperatures. That is, when the liquid crystal display panel has an active matrix structure in which an a.c. voltage is applied across the liquid crystal cells, it is required to write color data by alternate application of both the positive polarity and the negative polarity. Therefore, in such an active matrix structures, the substantial frame frequency f will be lowered to about 31 Hz which is only about ½ of the aforementioned frame frequency f.

JP-A-61-52631 is referenced as another prior art document related to the present invention. JP-A-61-52631 discloses a display panel driving apparatus in which a column-direction signal wire drive circuit driving column-direction signal wires of a display panel is divided into a plurality of drive circuits so as to shorten the period of time required for data writing. However, in the disclosed display panel driving apparatus, a plurality of shift registers and sample/hold circuits must be disposed in the preceding stage of the individual drive circuits, resulting in complexity of the circuit structure.

SUMMARY OF THE INVENTION

It is an object of the present invention to provide an apparatus for driving a color liquid crystal display panel operating at a high frame frequency.

The display panel driving apparatus of the present invention includes a column-direction drive circuit which is divided into N drive circuits. Further, a line memory having a memory capacity corresponding to one line is connected to the column-direction drive circuit. As in the case of the column-direction drive circuit divided into the N drive circuits, the line memory is also divided into N memory regions, and its i-th memory region ($i \leqq N$) is connected to the i-th drive circuit. Picture data are stored in the sequential order from the first region to the N-th region of the line memory. At the time where picture data of one line are completely stored in the line memory, the picture data are transferred from the individual memory regions to the associated drive circuits respectively. This data transfer is such that the data are simultaneously transferred from the individual regions of the line memory to the associated column-direction drive circuits respectively. Alternatively, the picture data are transferred sequentially or serially at a high speed in a relation divided into units.

DESCRIPTION OF THE PREFERRED EMBODIMENTS

Figure 1:
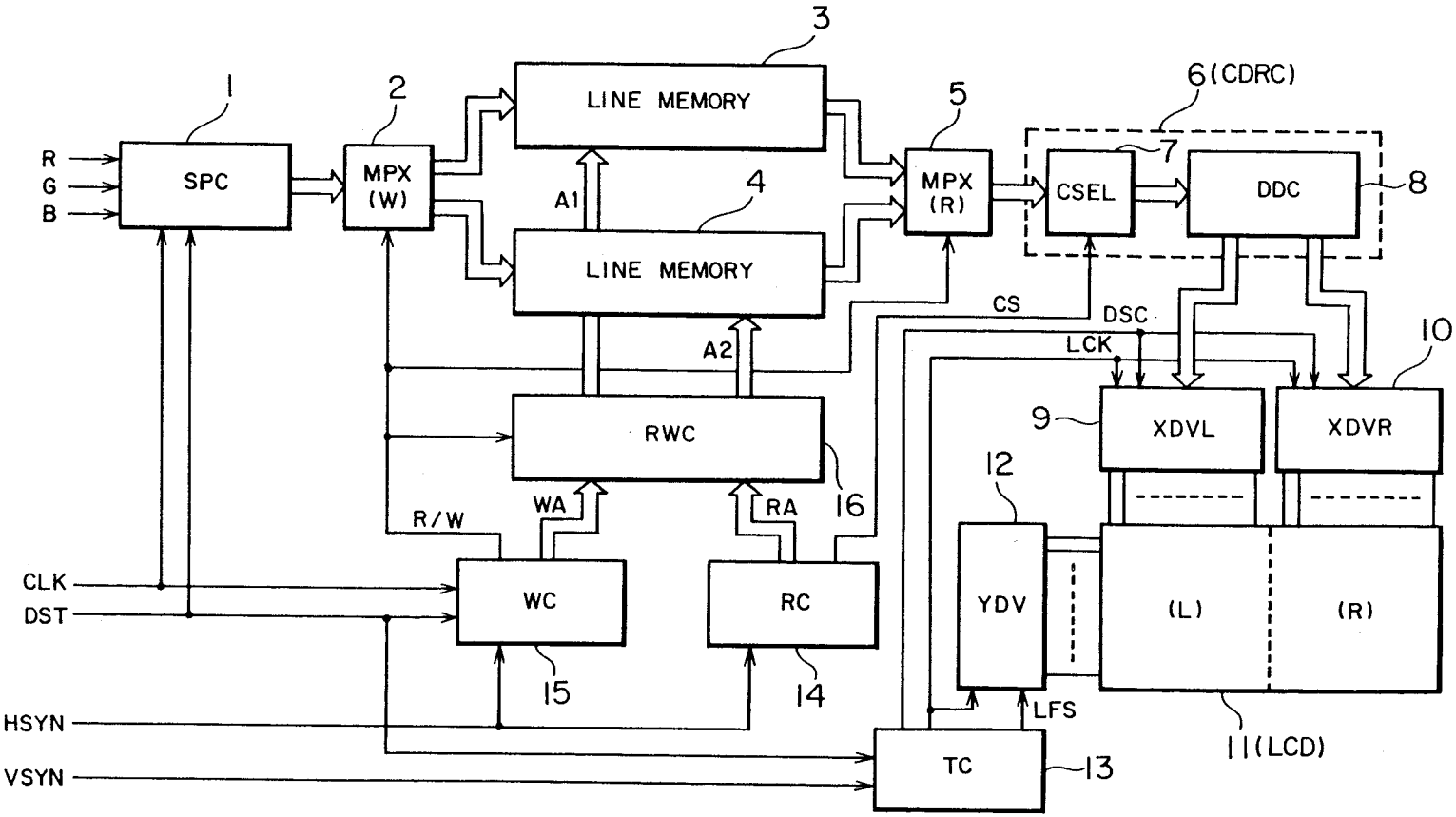
FIG. 1 is a block circuit diagram of an embodiment of the display panel driving apparatus of the present invention.

FIG. 1 is a block circuit diagram of a preferred embodiment of the display panel driving apparatus according to the present invention.

In the illustrated embodiment, a color liquid crystal display panel LCD having an active matrix structure is used as a color display. As shown in detail in FIG. 3, the color liquid crystal display panel LCD is designed to display picture data with 640 dots×200 lines, although these FIGURES are in no way limiting. Each line includes three lines, that is, a line covered with a red filter, a line covered with a green filter and a line covered with a blue filter. Y selection (scan) wires (row-direction signal wires) Y1, Y2, Y3; Y4, Y5, Y6; . . . ; Y598, Y599, Y600 are provided for the lines No. 1 to No. 200 respectively. Also, column-direction signal wires X1 to X640 are disposed in one direction. Therefore, the color liquid crystal display panel LCD has a total of 640×600 picture elements (pixels), because 600 Y-selection signal wires are disposed in the other direction as described above.

Referring to FIG. 1, color display data R, G and B are supplied to a serial/parallel conversion circuit SPC 1 in the display panel driving apparatus. By the combination of these color data of three primary colors, a color picture of eight colors (including white and black) can be displayed on the color liquid crystal display panel LCD 11. In synchronism with the supply of the color display data R, G and B, a dot clock signal CLK is applied to the serial/parallel conversion circuit SPC 1. A display timing signal DST is also applied to the serial/parallel conversion circuit SPC 1. When this display timing signal DST is in its high level, the combination of the supplied display data is displayed as visible information (effective display data), while when the display timing signal DST is in its low level, a horizontal retrace period starts without displaying the display data. A horizontal synchronizing signal HSYN is a timing signal which controls one line, and a vertical synchronizing signal VSYN is a timing signal which controls one frame.

The three color display data R, G and B serially supplied to the serial/parallel conversion circuit SPC 1 according to the dot clock signal CLK and display timing signal DST are converted into parallel data of 4 bits respectively. These 4-bit parallel data are supplied as an input to a write memory selection circuit (referred to hereinafter as a multiplexer) MPX 2.

The color display data converted into the 4-bit parallel data are selectively supplied through the multiplexer MPX 2 to a write input terminal of a first line memory 3 and a write input terminal of a second line memory 4 under control of a control signal R/W described later.

Each of the first and second line memories 3 and 4 has a memory capacity capable of storing color display data corresponding to one line of the color liquid crystal display panel LCD 11. That is, a memory capacity of 640 dots×3 color bits is required for each of the first and second line memories 3 and 4 because the color liquid crystal display panel LCD 11 has the display capacity of 640 dots in the horizontal direction. Because the parallel data generated from the serial/parallel conversion circuit SPC 1 are supplied to the first and second line memories 3 and 4 as described above, the unit of data bits used for memory access is 4×3 bits. Therefore, each of the first and second line memories 3 and 4 is designed to have addresses No. 1 to No. 159 as described later. A static random access memory (a static RAM) is utilized to act as each of the first and second line memories 3 and 4, although the type of the line memories is in no way limited to such a RAM. In lieu of such a static memory cell, a dynamic memory cell can also be utilized. This is because, for each of the first and second line memories 3 and 4, one writing operation and three reading operations are alternately carried out in one horizontal period as described later. Since such writing operation and reading operations are repeated at very short time intervals as described above, the line memories 3 and 4 are to be continuously refreshed. Therefore, even when a dynamic memory cell is used in lieu of the static memory cell, memory access can be made as in the case where the static memory cell is used. Thus, the area occupied by the first and second line memories 3 and 4 can be further decreased in conjunction with the small memory capacity.

A read memory selection circuit (referred to hereinafter as a multiplexer) MPX 5 is connected to read output terminals of the first and second line memories 3 and 4. This read-purpose multiplexer MPX 5 and the write-purpose multiplexer MPX 2 are changed over in a complementary fashion. For example, when the write-purpose multiplexer MPX 2 acts to supply parallel display data to one of the first and second line memories 3 and 4 under control of the control signal R/W, the read-purpose multiplexer MPX 5 acts to select data read out from the other line memory 4 or 3.

A write control circuit WC generates the control signal R/W and a write address signal WA in response to the application of the dot clock signal CLK, display timing signal DST and horizontal sychronizing signal HSYN. A read control circuit RC generates a read address signal RA and a 2-bit color selection signal CS in response to the application of the horizontal synchronizing signal HSYN. For example, when the control signal R/W generated from the write control circuit WC is in its high level, the multiplexer MPX 2 selects the first line memory 3. When the control signal R/W is thus in its high level, the write address signal WA generated from the write control circuit WC and applied to a read/write control circuit RWC is applied from the read/write control circuit RWC to the first line memory 3 as an address signal A1. In response to the application of this address signal A1, color display data R, G and B of three primary colors each corresponding to one line and serially supplied from the multiplexer MPX 2 are written in the first line memory 3.

On the other hand, the read address signal RA generated from the read control circuit RC and applied to the read/write control circuit RWC is applied from the read/write control circuit RWC to the second line memory 4 as an address signal A2. In response to the application of this address signal A2, color display data stored in the second line memory 4 are read out to be supplied to a color selection circuit CSEL 7 through the multiplexer MPX 5. In response to the application of the color selection signal CS, the output signal of the multiplexer MPX 5 appears serially from the color selection circuit CSEL 7 in the order of R, G and B.

Data to be displayed on a left-hand half display area of the color liquid crystal display panel LCD 11 are stored at odd-numbered addresses of the line memories 3 and 4, while data to be displayed on a right-hand half display area of the color liquid crystal display panel LCD 11 are stored at even-numbered addresses of the line memories 3 and 4. An X drive circuit driving the column-direction signal wires is also divided into a left-hand X drive circuit XDVL 9 for controlling display on the left-hand display area of the color liquid crystal display panel LCD 11 and a right-hand X drive circuit XDVR 10 for controlling display on the right-hand display area of the color liquid crystal display panel LCD 11. Each of the left-hand and right-hand X drive circuits XDVL 9 and XDVR 10 is connected to 320 signal wires of the color liquid crystal display panel LCD 11.

In response to the application of the odd-number and even-number address signals A1 and A2 from the read/-write control circuit RWC, data to be displayed on the left-hand and right-hand display areas of the color liquid crystal display panel LCD 11 are alternately read out from the first and second line memories 3 and 4 respectively. A divided data control circuit DDC 8 receives 4-bit data to be displayed on the left-hand display area and 4-bit data to be displayed on the right-hand display area and supplies the former and latter data to the left-hand and right-hand X drive circuits XDVL 9 and XDVR 10 respectively. Each of these X drive circuits XDVL 9 and XDVR 10 includes a shift register having four parallel bit inputs, and the 4-bit data supplied from the divided data control circuit DDC 8 to the shift registers are successively shifted. Shifting of 320 bits in each of the left-hand and right-hand X drive circuits XDVL 9 and XDVR 10 completes fetching of display data of one line. Therefore, the period of time required for the X drive circuit to fetch data of one line is only ½ of that required hitherto.

The outline of the apparatus embodying the present invention will be understood from the above description. The operation of the individual parts of the apparatus will now be described in greater detail.

In response to the application of the display timing signal DST and vertical synchronizing signal VSYN, a timing control circuit 13 generates a data shift clock signal DSC and a line clock signal LCK which are required for the operation of both the left-hand and right-hand X drive circuits XDVL 9 and XDVR 10 of the X drive circuit and which are required also for the operation of a Y drive circuit YDV 12. Further, the timing control circuit 13 generates a line front clock signal LFS which is applied to the Y drive circuit YDV 12. When the line front clock signal LFS applied to the Y drive circuit YDV 12 is in its high level, a high level appears on the scan signal wire Y1 in synchronism with the trailing edge of the line clock signal LCK. Thereafter, the scan signal wire on which the high level appears in synchronism with the trailing edge of the line clock signal LCK is shifted in the order of Y2, Y3, Y4, . . . , Y600 to carry out the scanning operation in the vertical direction.

Figure 2:
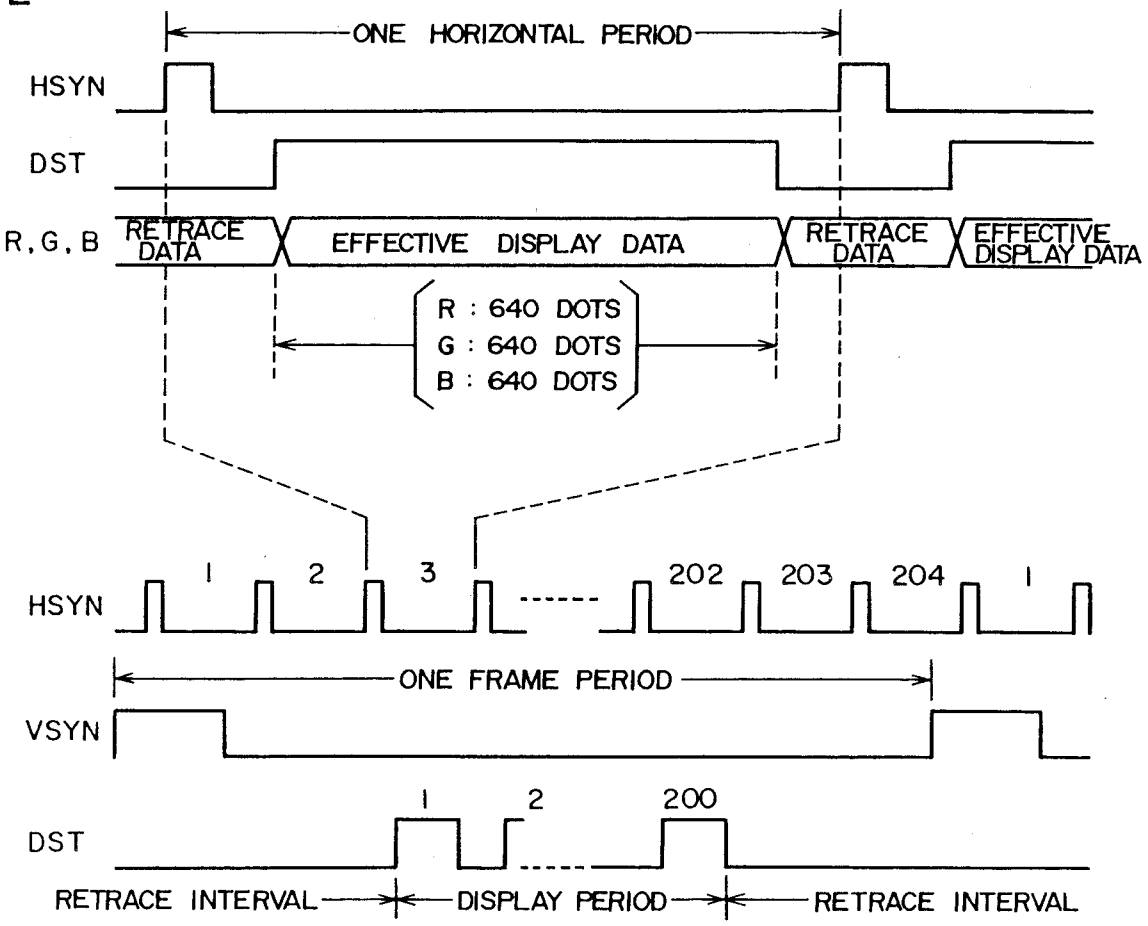
FIG. 2 is a timing chart of operation of the display panel driving apparatus shown in FIG. 1.

FIG. 2 is a timing chart illustrating the operation of the color display panel driving apparatus embodying the present invention.

In the color display panel driving apparatus of the present invention, one frame period is composed of 204 horizontal periods (HSYN), and the vertical synchronizing signal VSYN is generated in substantially synchronous relation with the horizontal period No. 1. A vertical retrace interval ranges from the horizontal period No. 203 in the preceding frame to the horizontal period No. 2 in the present frame. Therefore, the display operation in one frame is carried out in the 200 horizontal periods corresponding to the range of from the line No. 1 to the line No. 200 between the horizontal period No. 3 and the horizontal period No. 202.

The horizontal synchronizing signal HSYN determines each horizontal period. As shown in an enlarged scale in FIG. 2, color display data R, G and B appear as effective display data during the period of time in which the display timing signal DST remains in its high level, and, in the other periods, horizontal retrace data displays black. As described already, the number of dots (bits) of each of the effective color display data R, G and B is 640.

Figure 3:
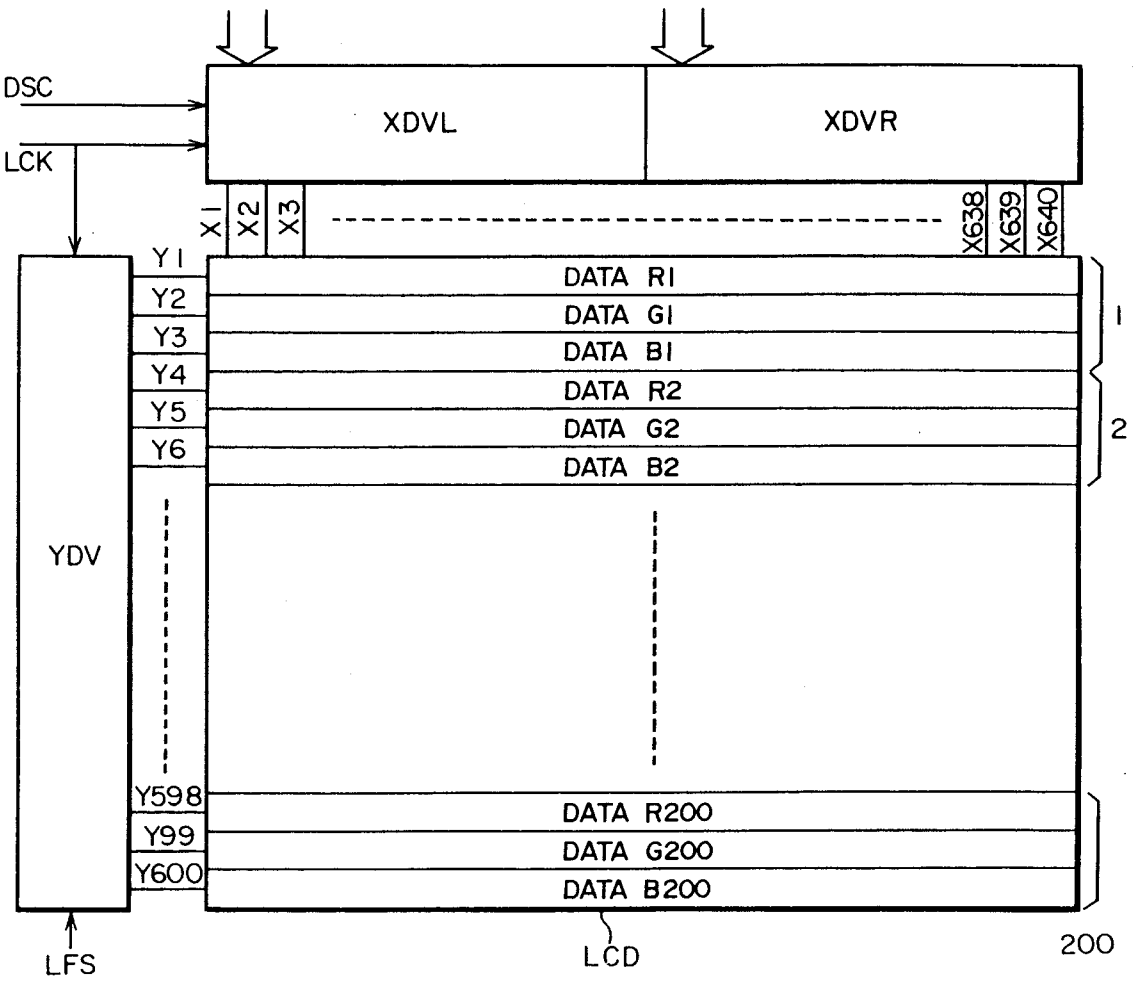
FIG. 3 is a block circuit diagram of the color liquid crystal display panel and its peripheral circuits in the display panel driving apparatus shown in FIG. 1.

FIG. 3 shows the color liquid crystal display panel LCD 11 to which the left-hand and right-hand X drive circuits XDVL 9, XDVR 10 and the Y drive circuit YDV 12 are connected.

As described already, the color liquid crystal display panel LCD 11 is provided with color filters of a lateral stripe pattern, and one line is composed of three trains or lines of pixels of R, G and B. The Y drive circuit YDV 12 has scan wires Y1 to Y600 as described already. In response to the application of the line front clock signal LFS generated at the front of each frame, a high level is shifted in synchronism with the line clock signal LCK to provide the Y selection signal. Since one line is composed of three lines of R, G and B, one horizontal period is divided into three periods with respect to time as described later. When data R1 of 640 dots is supplied from the left-hand and right-hand X drive circuits XDVL 9 and XDVR 10, the scan wire Y1 is selected. Similarly, the scan wires Y2 and Y3 are selected when 640-dot data G1 and B1 are supplied respectively. Thus, color picture data of the line No. 1 are written in the corresponding pixels of the color liquid crystal display panel LCD 11 in one horizontal period. Then, when 640-dot data R2 is supplied from the left-hand and right-hand X drive circuits XDVL 9 and XDVR 10 in the next horizontal period, the scan wire Y4 is selected. Similarly, the scan wires Y5 and Y6 are selected when 640-dot data G2 and B2 are supplied respectively. Thus, color picture data of the next line No. 2 are written in the corresponding pixels of the color liquid crystal display panel LCD 11. The writing operation continues until color picture data R200, G200 and B200 of the last line No. 200 are written in the corresponding pixels of the color liquid crystal display panel LCD 11. The above writing operation completes writing of color picture data of one frame. For the a.c. drive of the color liquid crystal display panel LCD 11, the same display data R1, G1, B1; . . . ; R200, G200, B200 inverted in polarity are generated from the left-hand and right-hand X drive circuits XDVL 9 and XDVR 10, and the scan wires are similarly selected in synchronism with generation of the data output from the X drive circuits XDVL 9 and XDVR 10. Therefore, two frames are required to display one picture on the color liquid crystal display panel LCD 11 of the active matrix structure.

Figures 4, 5:
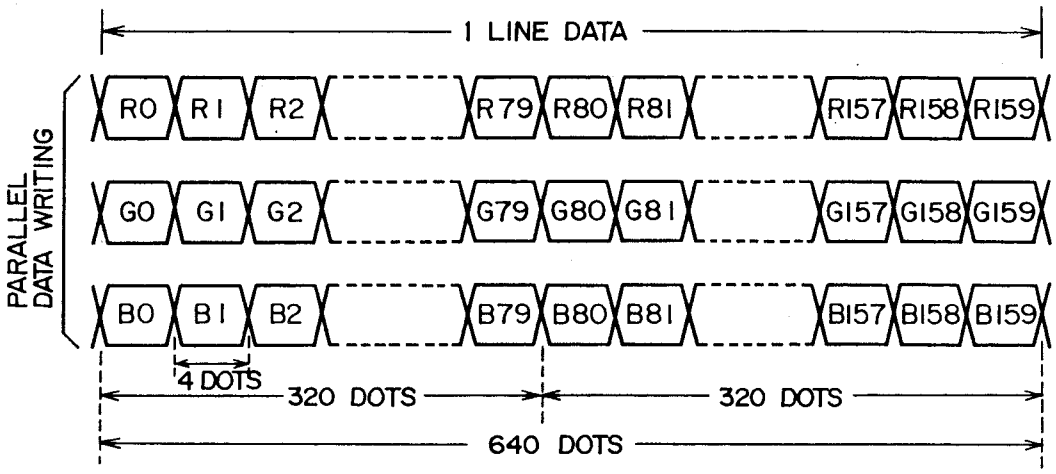
FIG. 4 shows an example of data written in the line memories shown in FIG. 1.
FIG. 5 shows an address map of the line memories shown in FIG. 1.

FIG. 4 is a timing chart illustrating an example of color display data written in the first and second line memories 3 and 4.

Color display data R, G and B serially supplied to the serial/parallel conversion circuit SPC 1 are converted into 4-bit parallel data which are written in one of the first and second line memories 3 and 4. That is, 4-bit data signals R0 to R159, G0 to G159 and B0 to B159 corresponding to red, green and blue respectively are written in each of the first and second line memories 3 and 4. Thus, a total of color display data of $160 \times 4 = 640$ bits for each color are written in each of the first and second memories 3 and 4.

FIG. 5 shows an address map of the first and second line memories 3 and 4.

In the apparatus embodying the present invention, the X drive circuit is divided into the left-hand X drive circuit XDVL 9 and right-hand X drive circuit XDVR 10 as described already so as to increase the frame frequency. For this purpose, the even-numbered addresses No. 0, No. 2, . . . , No. 158 are allotted to store the data signals R0 to R79, G0 to G79 and B0 to B79 to be supplied to the left-hand X drive circuit XDVL 9 respectively, while the odd-numbered addresses No. 1, No. 3, . . . , No. 159 are allotted to store the data signals R80 to R159, G80 to G159 and B80 to B159 to be supplied to the right-hand X drive circuit XDVR 10 respectively. Thus, the data to be displayed on the left-hand display area of the color liquid crystal display panel LCD 11 are stored at the odd-numbered addresses of each of the first and second line memories 3 and 4, while the data to be displayed on the right-hand display area are stored at the even-numbered addresses of each of the first and second line memories 3 and 4. The number of bits of color display data stored at each address is $4\times3=12$ bits.

Figure 6:
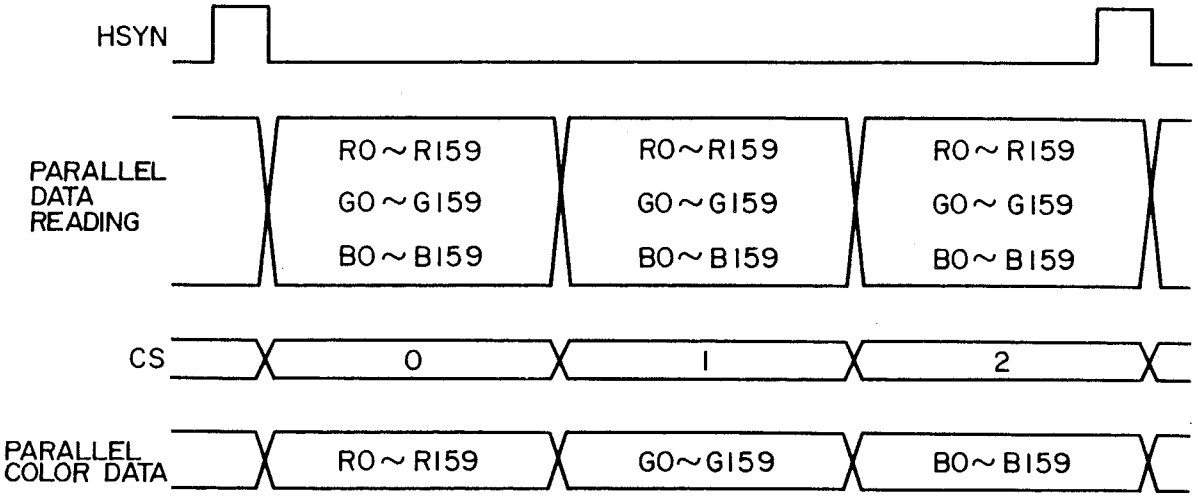
FIG. 6 is a timing chart showing the timing of reading out data from the line memories shown in FIG. 1.

FIG. 6 is a timing chart illustrating the timing of reading out data from the first or second line memory 3 or 4.

While data are being written in the line memory 3 or 4, the read address signal RA generated from the read control circuit RC 14 is applied to the other line memory 4 or 3, and the data signals read out from the line memory 4 or 3 are transmitted by changing over the multiplexer MPX 5. The read control circuit RC 14 generates the read address signal RA so that the reading operation for the selected line memory 4 or 3 is repeated three times in one horizontal period. Therefore, the parallel data R0 to R159, G0 to G159 and B0 to B159 are repeatedly used out three times and pass through the multiplexer MPX 5.

According to the number of times of data reading under control of the read control circuit RC 14, the timing control circuit TC 13 generates a 2-bit color selection signal CS. For example, in the case of the first reading operation, the color selection signal CS of "0" (00) is generated, and the color display data R0 to R159 among those of three primary colors are supplied through the color selection circuit CSEL 7. In the case of the second reading operation, the color selection signal CS of "1" (01) is generated, and the color display data G0 to G159 among those of three primary colors are supplied through the color selection circuit CSEL 7. In the case of the third reading operation, the color selection signal CS of "2" (10) is generated, and the color display data B0 to B159 among those of three primary colors are supplied through the color selection circuit CSEL 7.

As described already, the color display data R0 to R159, G0 to G159 and B0 to B159 are stored in the first and second line memories 3 and 4 in such a relation that the data R0 to R79, G0 to G79 and B0 to B79 are stored at the even-numbered addresses, while the data R80 to R159, G80 to G159 and B80 to B159 are stored at the odd-numbered addresses. Therefore, when the read address signal RA is generated in the sequential order of, for example, the addresses No. 0 to No. 159, the color display data, for example, R0, R80 and R1, R81 to be displayed on the left-hand and right-hand display areas respectively are alternately supplied. The divided data control circuit DDC 8 acts to temporarily latch the color display data to be displayed on the left-hand and right-hand display areas through the left-hand and right-hand X drive circuits XDVL 9 and XDVR 10 respectively and supplies those color display data to the left-hand and right-hand X drive circuits XDVL 9 and XDVR 10. When the serial data transfer rate of the left-hand and right-hand X drive circuits XDVL 9 and XDVR 10 is, for example, 6 MHz as described above, the color display data are read out from the line memories 3 and 4 at a rate two times as high as the serial data transfer rate.

The parallel color display data divided in the manner described above are supplied to the left-hand and right-hand X drive circuits XDVL 9 and XDVR 10, and the 4-bit color display data R0 to R79 and the 4-bit color display data R80 to R159 are shifted in these circuits in synchronism with the data shift clock signal DSC. After these color display data are completely shifted, they are supplied in parallel to the color liquid crystal display panel LCD 11 by way of the respective signal wires X1 to X640 in synchronism with the line clock signal LCK. The other color display data G0 to G79, G80 to G159, B0 to B79, and B80 to B159 are similarly supplied to the color liquid crystal display panel LCD 11. On the other hand, the Y drive circuit YDV 12 selects the signal wires in the order of Y1, Y2, Y3, . . . in synchronism with the line clock signal LCK so that the display operation corresponding to the individual color lines is carried out.

The display panel driving apparatus embodying the present invention includes two line memories 3 and 4 as described above. While display data are being written in one of the line memories, display data already written in the other line memory are read out for the purpose of picture display. Thus, the apparatus of the present invention includes a memory circuit having a memory capacity of only two lines. Therefore, in contrast to a prior art apparatus including a frame memory, such a small-capacity memory circuit can be used to display a picture of high quality on a display panel having a large display area. More concretely, when the number of lines required to display a picture is N, the present invention is advantageous over the prior art in that the required memory capacity can be greatly decreased to 2/N.

Further, because the X drive circuit is divided into two circuits, the period of time required for data transfer is decreased to ½ of that required when the X drive circuit is not divided. In other words, from the viewpoint of the operation of the entire apparatus, this is equivalent to doubling the data transfer rate of the X drive circuit. Therefore, as will be apparent from the foregoing description, the frame frequency can be increased to a high frequency as high as 125 Hz. Thus, even when the same display data are written with the positive and negative polarities for the a.c. drive of the liquid crystal display panel LCD, the frame frequency can be set at 62.5 Hz, and it is possible to display a picture of high quality showing less flickering than that observed on a picture displayed on a home-use television receiver.

The display panel driving apparatus embodying the present invention provides various advantages as enumerated below.

(1) A first and a second line memory each storing color display data corresponding to one line of a color display panel are provided, and color display data are alternately written in and read out from these first and second line memories under control of a read/write control circuit. The color display data alternately read out from the first and second line memories are divided into parallel data and supplied to an X drive circuit which is divided into a plurality of corresponding drive circuits. In the apparatus of the present invention, the memory circuit used for storing color display data has thus a memory capacity of storing data of two lines only. Therefore, the memory capacity of the memory circuit required for the picture displaying operation can be decreased.

(2) Because of the advantage described in (1), the liquid crystal display controller can be provided by a semiconductor integrated circuit integrated on one chip, and the structure of the system can be greatly simplified.

(3) The X drive circuit is divided into the plural drive circuits so that color display data stored in the first and second line memories can be supplied in parallel to the corresponding X drive circuits. This is equivalent to an increase in the data transfer rate of the X drive circuit. Therefore, the frame frequency can be increased, and a picture of high quality substantially free from flickering can be displayed on the color display panel.

(4) In a liquid crystal display panel having a structure of an active matrix, pixels are regarded to be equivalent to capacities holding display data. In such an active matrix structure, leakage current increases with the increase in the temperature. According to the present invention, the frame frequency can be increased as described above so that the number of times of data writing per unit time can be increased. Therefore, data can be satisfactorily displayed even at high temperatures.

(5) The division of the X drive circuit permits the use of the existing drive circuit for driving a liquid crystal display panel having a larger display area and capable of displaying a picture of higher density.

Figure 7:
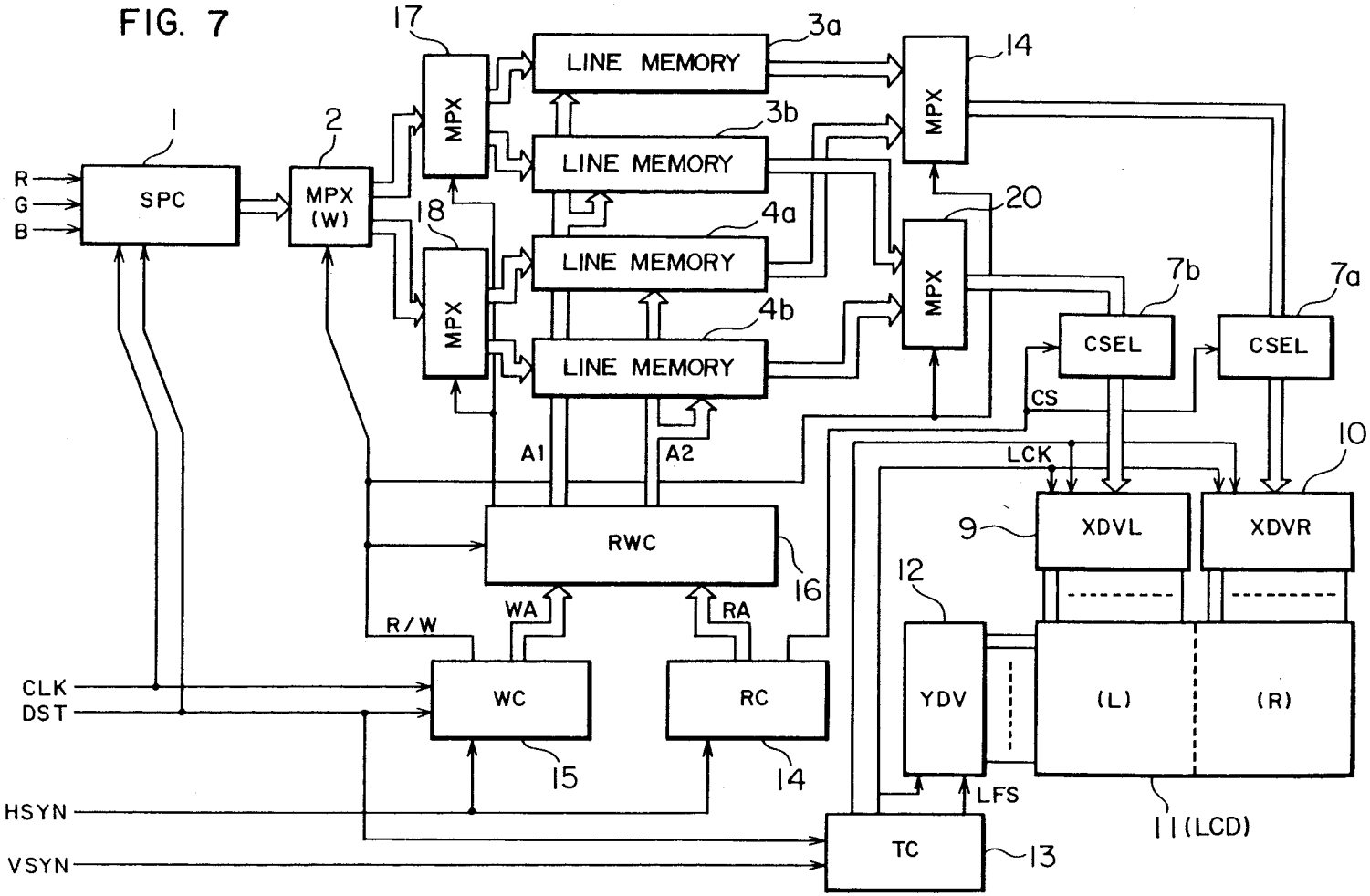
FIG. 7 is a block circuit diagram of another embodiment of the display panel driving apparatus of the present invention.

A second embodiment of the present invention will now be described with reference to FIG. 7. In FIG. 7, like reference numerals and symbols are used to designate like parts and signals appearing in FIG. 1. The display panel driving apparatus shown in FIG. 7 differs from that shown in FIG. 1 in that line memories 3*a* and 3*b* for storing data to be displayed on a right-hand half display area of a liquid crystal display panel LCD 11 are provided separately from line memories 4*a* and 4*b* for storing data to be displayed on a left-hand half display area.

Referring to FIG. 7, the two line memories 3*a* and 3*b* store data of one line. Thus, the combination corresponds to the line memory 3 shown in FIG. 1. Similarly, the combination of the line memories 4*a* and 4*b* stores data of one line and corresponds to the line memory 4 shown in FIG. 1.

The line memories 3*a* and 4*a* are connected at their output terminals to a right-hand X drive circuit XDVR 10 through a multiplexer MPX 19 and a color selection circuit CSEL 7*a*, and the line memories 3*b* and 4*b* are connected at their output terminals to a left-hand X drive circuit XDVL 9 through a multiplexer MPX 20 and a color selection circuit CSEL 7*b*.

The line memories 3*a* and 3*b* are connected at their input terminals to a multiplexer MPX 2 through a multiplexer MPX 17, and the line memories 4*a* and 4*b* are connected at their input terminals to the multiplexer MPX 2 through a multiplexer MPX 18.

As in the case of the multiplexer MPX 2 shown in FIG. 1, the output terminals of the multiplexer MPX 2 shown in FIG. 7 are changed over every one line. When input data are R0 to R79, G0 to G79 and B0 to B79, the multiplexers MPX 17 and MPX 18 supply these data to the line memories 3*a* and 4*a*, while when input data are R80 to R159, G80 to G159 and B80 to B159, the multiplexers MPX 17 and MPX 18 supply these data to the line memories 3*b* and 4*b*. Therefore, data to be displayed on the right-hand display area of the liquid crystal display panel LCD 11 are stored in the line memories 3*a* and 4*a*, while data to be displayed on the left-hand display area are stored in the line memories 3*b* and 4*b*.

Writing and reading of data of one line in and from the line memories 3*a* and 3*b* will now be described. The same applies to the line memories 4*a* and 4*b*.

An address signal A1 successively indicating the addresses No. 0 to No. 79 is continuously applied to the line memories 3*a* and 3*b* from a read/write control circuit RWC 16. Therefore, with the change-over of the multiplexer MPX 17, data R0, G0, B0; . . . ; R79, G79, B79 are stored at the addresses No. 0 to No. 79 respectively of the line memory 3*a*, and data R80, G80, B80; . . . ; R159, G159, B159 are stored at the addresses No. 0 to No. 79 respectively of the line memory 3b.

In the data read mode, the line memories 3*a* and 3*b* are connected through the multiplexers MPX 19 and MPX 20 to the right-hand and left-hand X drive circuits XDVR 10 and SDVR 9 respectively. The address signal A1 indicating the same address (between the address No. 0 and the address No. 79) is sequentially applied from the read/write control circuit RWC 16 to the line memories 3*a* and 3*b* at the same time. According to the address indicated by the address signal A1, the data to be displayed on the right-hand and left-hand display areas of the liquid crystal display panel LCD 11 are simultaneously read out from the line memories 3*a* and 3*b* to be supplied to the right-hand and left-hand X drive circuits XDVR 10 and XDVL 9 respectively. As in the case of the right-hand and left-hand X drive circuits XDVR 10 and XDVL 9 shown in FIG. 1, the data are supplied from the right-hand and left-hand X drive circuits XDVR 10 and XDVL 9 in parallel to scan wires of the liquid crystal display panel LCD 11 as soon as shift of 320 bits is completed in each of these drive circuits XDVR 10 and XDVL 9.

This second embodiment is also advantageous in that the period of time required for data supply from the right-hand and left-hand X drive circuits XDVR 10 and XDVL 9 can be decreased to ½ of that required hitherto.

While preferred embodiments of the present invention have been described above, it is apparent that the present invention is in no way limited to such specific embodiments, and various changes and modifications may be made therein without departing from the subject matter of the present invention. For example, the X drive circuit may be divided into N circuits, where N is three or more. In such a case, the substantial data transfer rate of the X drive circuit can be increased to N times as high as that observed when the X drive circuit is not divided. For example, the X drive circuit shown in FIG. 1 may be divided into four circuits, and the number of bits of parallel data generated from the serial/parallel conversion circuit SPC 1 may be decreased from four to two. Although the frame frequency remains the same in such a modification, 2-bit serial shift registers can be used to constitute the X drive circuit so that the structure of the X drive circuit can be simplified. Further, the X drive circuit divided into N circuits may be integrated into a single semiconductor integrated circuit. That is, a plurality of X drive circuits may be integrated to form a single semiconductor integrated circuit. This arrangement can decrease the number of parts of the display panel driving apparatus. Further, the practical structure of the memory control circuits for executing alternate writing and reading of data in and from the two line memories may be embodied in various forms.

It is apparent that the present invention is applicable to the drive of various color display panels of matrix structure although its application to the drive of a color liquid crystal display panel has been described by way of example.

We claim:

1. A display panel driving apparatus comprising:

first memory means for storing data of at least one line by first storing of ½ of a line at odd-numbered addresses and then storing data of a remaining ½ of a line at even-numbered addressed;

second memory means for storing data of at least one line by first storing data of ½ of a line at odd-numbered addresses and then storing data of a remaining ½ of a line at even-numbered addresses;

first selecting means for alternately supplying data of first and second lines to said first and second memory means, respectively;

second selecting means for alternately reading out data of the first and second lines from said first and second memory means, respectively;

a display panel including pixels arranged in M rows and N columns to display data by those of the pixels which are selected by a combination of row-direction signal wires and column-direction signal wires, said display panel being divided into a first display area and a second display area separated by the column-direction signal wires;

a column-direction signal wire drive circuit connected to said second selecting means, said drive circuit including first column driving means for supplying the data read out from said first and second memory means to those of the column-direction signal wires which are associated with said first display area of said display panel, second column driving means for supplying the data read out from said first and second memory means to those of the column-direction signal wires which are associated with said second display area of said display panel, and divided data control means for supplying the data read out from the odd-numbered addresses of said first and second memory means to said first column driving means and for supplying the data read out from the even-numbered addresses of said first and second memory means to said second column driving means; and a row-direction signal wire drive circuit for successively selecting the row-direction signal wires.

2. A display panel driving apparatus according to claim 1, wherein said first and second column driving means include serial to parallel conversion means connected at bit outputs of said first and second column driving means to the column-direction signal wires associated with said first and second display areas of said display panel, respectively.

3. A display panel driving apparatus according to claim 1, wherein data of one line stored in each of said first and second memory means include three kinds of color data corresponding to three primary colors respectively, and, after the data of the one line are read out three contiguous times from each of said first and second memory means in data read mode, the color data are selected by a color selection circuit to be supplied to said column-direction signal wire drive circuit.

4. A display panel driving apparatus comprising:

a display panel including pixels arranged in M rows and N columns to display data by those of the pixels which are selected by a combination of row-direction signal wires and column-direction signal wires, said display panel being divided into a first display area and a second display area separated by the column-direction signal wires;

memory means including a first memory region for storing data to be displayed on said first display area of said display panel, and a second memory region for storing data to be displayed on said second display area of said display panel, the data stored in said first and second memory regions being first written in said first memory region and then written in said second memory region in a data write mode;

a column-direction signal wire drive circuit connected to said memory means, said drive circuit including first column driving means connected to those of the column-direction signal wires associated with said first display area of said display panel to supply data read out from said first memory region of said memory means to the column-direction signal wires associated with said first display area, and second column driving means connected to those of the column-direction signal wires associated with said second display area of said display panel to supply data read out from said second memory region of said memory means to the column-direction signal wires associated with said second display area, the data read out from said first memory region of said memory means and the data read out from said second memory region of said memory means being simultaneously supplied to said first column driving means and said second column driving means, respectively; and a row-direction signal wire drive circuit for successively selecting the row-direction signal wires.

5. A display panel driving apparatus according to claim 4, wherein said first and second column driving means include serial to parallel conversion means connected at bit outputs of said first and second column driving means to the column-direction signal wires associated with said first and second display areas of said display panel, respectively.

6. A display panel driving apparatus according to claim 4, wherein said memory means includes a plurality of unit memories each including said first memory region and said second memory region so that, when data are written in one of said unit memories, data are read out from another of said unit memories.

7. A display panel driving apparatus according to claim 5, wherein at least one unit memory stores data of one line to be displayed on said display panel.

8. A display panel driving apparatus according to claim 4, wherein a combination of said first memory region and said second memory region of said memory means stores data of one line to be displayed on said display panel.

9. A display panel driving apparatus comprising:

a display panel including pixels arranged in M rows and N columns to display data by those of the pixels which are selected by a combination of row-direction signal wires and column-direction signal wires, said display panel being divided into a plurality of display areas separated by the column-direction signal wires;

memory means including a plurality of memory regions corresponding to said plurality of display areas of said display panel, wherein data is successively written in said plurality of memory regions in sequential order in a data write mode;

a column-direction signal wire drive circuit connected to said memory means, said drive circuit including a plurality of column driving means corresponding to said plurality of display areas of said display panel, wherein data is simultaneously supplied to said plurality of column driving means from said plurality of memory regions of said memory means, respectively, each of said plurality of column driving means being connected to those of the column-direction signal wires associated with one of said plurality of display areas of said display panel so as to supply data read out from said memory means to the column-direction signal wires; and a row-direction signal wire drive circuit for successively selecting the row-direction signal wires.

* * * * *